United States Patent [19]

Chang

[11] Patent Number: 4,662,283

[45] Date of Patent: May 5, 1987

[54] TOY RAILROAD ABLE TO CHANGE THE TOY TRAFFIC DIRECTION

[76] Inventor: Hsien-Yang Chang, Fl. 2, No 2-2, Lane 762, Ding Chou Rd., Taipei, Taiwan, Taiwan

[21] Appl. No.: 812,127

[22] Filed: Dec. 23, 1985

[51] Int. Cl.[4] ..... E01B 23/06

[52] U.S. Cl. ..... 104/130; 104/DIG. 1; 238/10 F; 246/415 A

[58] Field of Search ..... 104/130, 130.1, 132, 104/140, 141, 195, DIG. 1, 102, 96; 238/10 A, 10 F, 10 R; 246/415 R, 415 A, 419, 430

[56] References Cited

U.S. PATENT DOCUMENTS

| | | | |
|---|---|---|---|
| 520,064 | 5/1894 | Leake | 104/130 |
| 2,977,893 | 4/1961 | Rosenbaum | 104/130 |
| 3,205,833 | 9/1965 | Fitzpatrick | 246/415 A |
| 3,471,690 | 10/1969 | McRoskey et al. | 246/415 A |
| 3,550,534 | 12/1970 | Rooklyn | 104/130 |
| 3,630,524 | 12/1971 | Cooper | 238/10 F |
| 3,808,974 | 5/1974 | Ward | 104/130 |
| 3,927,619 | 12/1975 | Bradley | 104/130 |
| 4,109,584 | 8/1978 | Mihirogi | 104/130 |
| 4,393,786 | 7/1983 | Dull et al. | 104/130 |

*Primary Examiner*—Randolph A. Reese

*Attorney, Agent, or Firm*—Asian Pacific International

[57] ABSTRACT

A toy railroad track which is adapted to guide the movements of a toy vehicle has at the bottom of the track two control plates which are attached to a fixed plate. A rack plate is engaged with a pinion mounted at the free end of the shaft of a small motor. Upon the pinion being driven by the small motor, the rack plate can be driven to move laterally; simultaneously, the rack plate will actuate the two control plates to move, and then the flanges of the control plates will extend out of the rail grooves to close one path and open the for the running toy.

5 Claims, 2 Drawing Figures

TOY RAILROAD ABLE TO CHANGE THE TOY TRAFFIC DIRECTION

BACKGROUND OF THE INVENTION

In conventional toy railroad generally one toy vehicle is capable of running in one direction. These toy railroads are rather monotonous, and they will soon be abandoned by the children because they lack variety and inspiration for childrens' imagination.

SUMMARY OF THE INVENTION

With many years of experiences in development of toys and in view of the disadvantages of known toy railroads, the inventor has developed the present invention, of which the prime features are that two control plates are mounted in a channel under the bottom of the track for the toy railroad, and a fixed plate is closely attached on the top of the two control plates so as to fix the two plates in position. A rack plate is mounted on the top of the fixed plate. A pinion to be driven with a small motor is adapted to engage with the rack plate or rack. Upon the small motor rotating, the rack plate will be driven to move laterally. In that case, the rack plate will cause the respective control plates to move, and the flanges on the control plates can extend out of the rail grooves so as to have one of the rail grooves closed, and the other groove open for a toy train or similar miniature vehicle or toy to run therein, sna vice versa with respect to the other groove.

It is another feature of the present invention that, after the two rail grooves are joined together, at least four long guide grooves are formed to extend in a symmetrical or patterned manner. The flange on one side of the control plate will extend out or in one guide groove to thereby close this guide groove, whereby the toy on the rail would be diverted to run in another direction.

It is still another feature of the present invention that the fixed plate is provided with two small holes. Upon the fixed plate being closely attached on the top of the control plates, the lugs of the track or a respective rib portion thereof will be inserted in to the small holes respectively and adhered therein. Simultaneously, the studs on the control plates will respectively pass through the associated oblong holes in the fixed plates and finally they are inserted into the round holes in the rack plate, respectively, for being adhered therein. Once assembled in this manner, the pinion on the small motor can drive the rack plate to move, and then the control plates can be driven by the rack plate to move laterally.

It is a further feature of the present invention that the small motor is fixedly mounted under the bottom of the toy railroad track, and can be driven to rotate bidirectionally so as to move laterally the rack plate moved and its associated control plates.

It is a still further feature of the present invention that at least four control plates are mounted at the joined portion or junction of the two rail channels so as to allow two way traffic and other varieties of the toy railroad.

DETAILED DESCRIPTION

Figure 1:
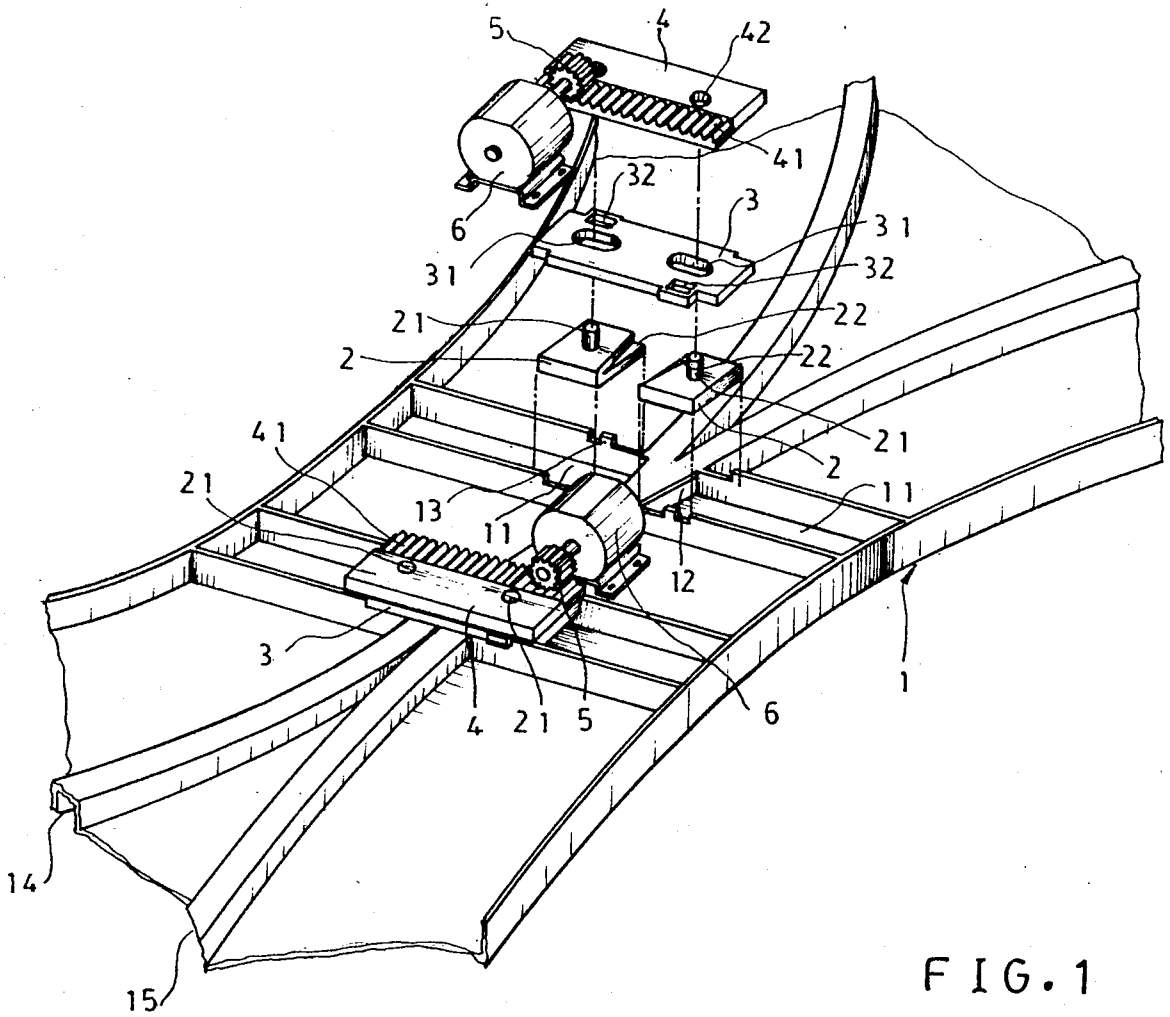
FIG. 1 is a perspective bottom view with some parts shown disassembled, of the present invention.

FIG. 1 shows in a perspective view the bottom of a section of the toy railroad track according to the present invention with some parts being shown in disassembled condition. A number of channels or ribs 11 is provided at suitable points under the bottom of the railroad track 1 control or switch plates 2 and 2' can be mounted at the ribs 11. Each of the top surfaces of the control plates 2 and 2' is provided with a stud 21. On the opposite side of each control plate (2, 2') is provided a flange 22 that extends out of the long channel 12. For the support of the control plates 2 and 2', there is furnished a mounting or fixed plate 3, which has two oblong holes 31 and two small holes 32. Upon the fixed plate 3 being attached closely to the control plates 2 and 2', the studs 21 will be put through the oblong holes 31 of the fixed plate 3; simultaneously, the lugs 13 on the railroad track 1 will be mounted in the small holes 32 for securing the fixed plate 3 at the bottom surface of the railroad track 1. On the top of each fixed plate 3, there is mounted with rack plate or rack 4 having rack teeth 41 at the bottom side thereof, and the rack plate 4 is also furnished with two round holes 42, through which two studs 21 are respectively inserted and then adhered therein. In that case, the rack plate 4 and the control plate 2 are fixed together to move. The rack teeth 41 can be engaged by a pinion 5 that is mounted on the free end of the shaft of the samll motor 6. Thus, the small motor 6 can, through the pinion 5, drive the rack plate 4 to displace it to the left and right, and in turn, the control plates 2 and 2' will be driven to move to the left and right according to the rotation of the motor 6.

Figure 2:
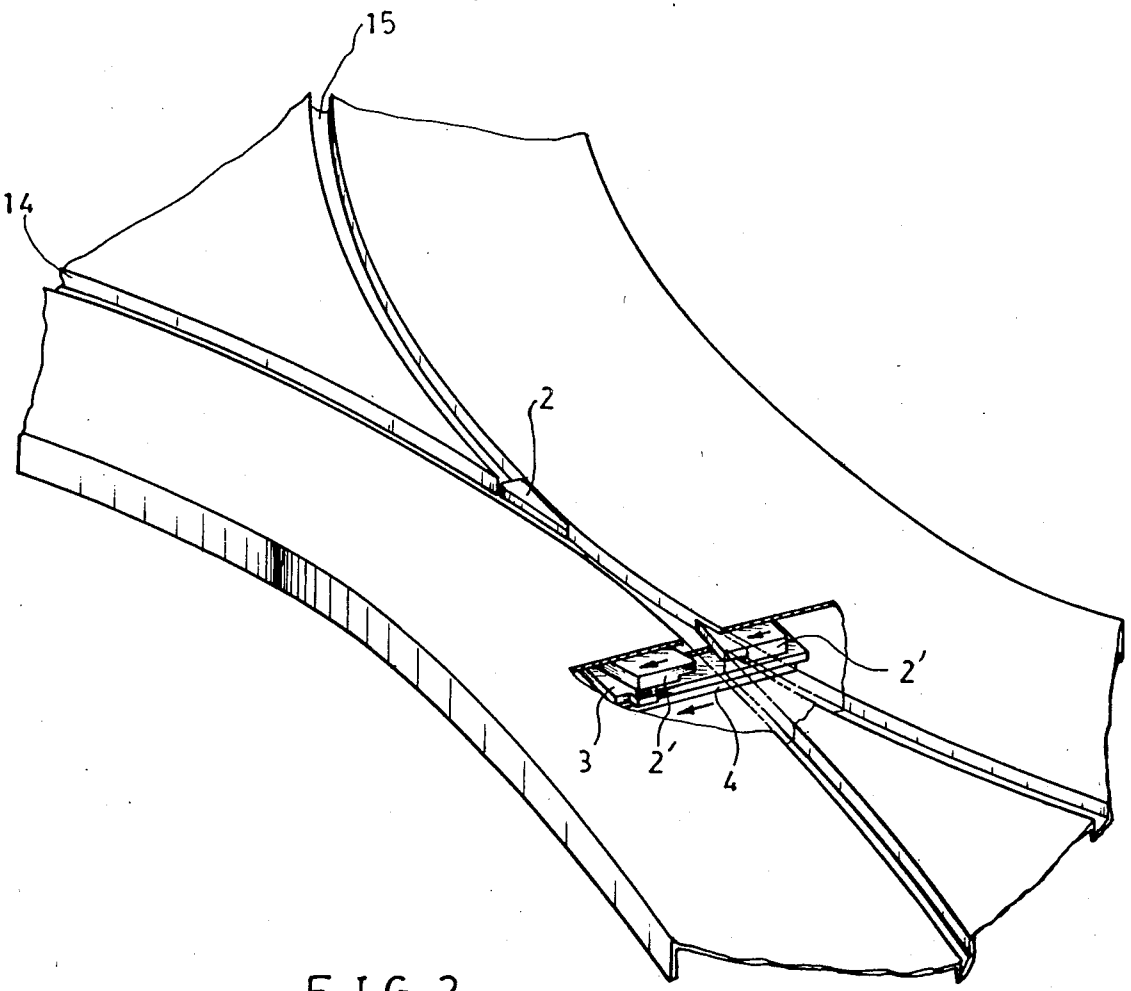
FIG. 2 is a perspective top view of an embodiment of the present invention indicating operation of the shown embodiment.

Referring to FIG. 2, there is indicated the operation of one embodiment according to the present invention showing the top view of the railroad track 1. It illustrates only a section of the railroad track 1, on which two rail channels or grooves 14 and 15 are provided in a converging and diverging manner so that they are joined together in a tangential portion and they then separated or diverge gradually from each other. Along the two inner sides of their contact portion or point of tangency, there are furnished long channels or openings 12 on the both ends of the contact portion so as to allow the flanges 22 of the control plates 2 and 2' to extend out of the long channels 12 and in the path of grooves 14 and 15.

The small motor 6 may be driven to rotate forwardly or reversely to actuate the pinion 5. Since the pinion 5 engages with the rack teeth 41, the pinion 5 can move the rack plate 4 to the left or right. The rack plate 4 can further drive the control plate 2 to displace it laterally so as to have the associated flange 22 extend in the long channel 12 so as to close one rail channel or groove 15, while the other rail channel or groove 14 is open and can be used for a toy car or the like.

A pair of control plates 2', furnished at a distance away from the single switch or control plate 2, can also be driven to extend in or out of the long channel 12 so as to let a toy run along the groove 14 only. Of course, the left control plate 2' can be driven to extend with respect to the long channel 12 so as to let the toy run along the groove 15 in the form of an "S"-shaped path. In that case, the circular path is modified and greater varieties can be obtained so as to increase the interest of children, and to inspire their imagination, and to train their ability in dealing with a change or even an emergency. Further, the length of the track may be increased, and additional control plates can be provided at a suitable point for enhanced varieties in playing with a toy on the rail. Therefore, it is considered a novel toy rail track providing for various layout options.

I claim:

1. A toy rail track capable of guiding the path of a toy vehicle moving thereon, said track comprising:

a substantially unitary track body defining guide grooves for a respective toy vehicle in one side thereof and defining a plurality of fastening lugs and a plurality of passages at the other side thereof;

a plurality of control plates, with each control plate being adapted to reach through its respective passage in said track body to selectively extend into the respective guide groove for controlling the path of a respective toy vehicle, each control plate having a flange which is dimensioned to close the guide groove in which it extends and each control plate having a stud for connecting the control plate to a respective rack plate;

a plurality of fixed plates for supporting respective control plates, with each fixed plate defining at least one oblong hole for passage therethrough of the stud of the associated control plate, and also defining at least one small hole for connecting the fixed plate to said track body by means of a fastening lug thereof, said fixed plate being arranged between at least one control plate an a respective rack plate;

a rack plate, said rack plate being arranged at a respective fixed plate, said rack plate defining rack teeth for engagement by a respective pinion, and said rack plate defining at least one matching mounting hole for receiving and adhering the stud of the associated control plate such that movement of the rack plate is imparted to the control plate; and a small motor with a pinion, said motor being adapted to rotate said pinion, and said pinion being adapted to operatively engage with the rack teeth of said rack plate for selectively opening and closing a guide groove in said track.

2. The toy railroad track according to claim 1 wherein said guide grooves are substantially disposed in the pattern of the letter X.

3. The toy railroad track according to claim 2 wherein two branching guide grooves are joined between their respective branching points by a substantial distance of a single groove.

4. The toy railroad track of claim 3 having at each branching point at least one control plate.

5. The toy railroad track of claim 3 having at least at one branching point at least a pair of control plates.

* * * * *